US006547007B2

(12) United States Patent
Szarka et al.

(10) Patent No.: US 6,547,007 B2
(45) Date of Patent: Apr. 15, 2003

(54) PDF VALVE

(75) Inventors: David D. Szarka, Duncan, OK (US); Henry E. Rogers, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/836,755

(22) Filed: Apr. 17, 2001

(65) Prior Publication Data

US 2002/0148614 A1 Oct. 17, 2002

(51) Int. Cl.[7] ..... E21B 34/10; E21B 34/00; E21B 34/14; E21B 43/12

(52) U.S. Cl. ..... 166/317; 166/318; 166/177.4; 166/327

(58) Field of Search ..... 166/317, 318, 166/327, 328, 154, 177.4, 242.8; 251/337, 368, 358

(56) References Cited

U.S. PATENT DOCUMENTS

| | | | | |
|---|---|---|---|---|
| 2,768,695 A | | 10/1956 | Althouse, Jr. et al. | 166/225 |
| 3,072,145 A | | 1/1963 | Nelson | 137/525.1 |
| 3,481,397 A | | 12/1969 | Baker | 166/225 |
| 4,474,241 A | | 10/1984 | Freeman | 166/317 |
| 4,475,599 A | * | 10/1984 | Akkerman | 137/630.14 |
| 4,478,286 A | * | 10/1984 | Fineberg | 166/324 |
| 4,729,432 A | | 3/1988 | Helms | 166/317 |
| 5,647,434 A | | 7/1997 | Sullway et al. | 166/242.8 |
| 5,909,771 A | | 6/1999 | Giroux et al. | 166/120 |

* cited by examiner

*Primary Examiner*—Heather Shackelford
*Assistant Examiner*—Brian Halford
(74) *Attorney, Agent, or Firm*—Carlos A. Torres; Browning Bushman, P.C.

(57) ABSTRACT

A differential float and cementing valve assembly used to position and cement casing in a well bore. A leaf spring and other components of the assembly are preferably constructed of composite materials and/or plastics that can be drilled up with polycrystalline diamond compact (PDC) bits.

27 Claims, 4 Drawing Sheets

FIG. 1A
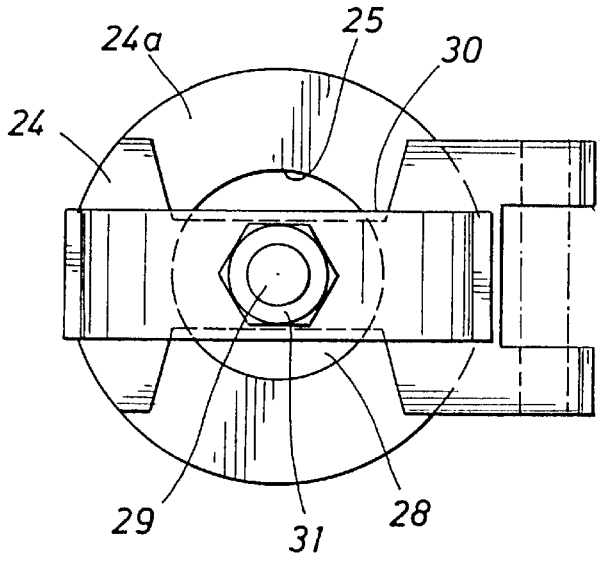
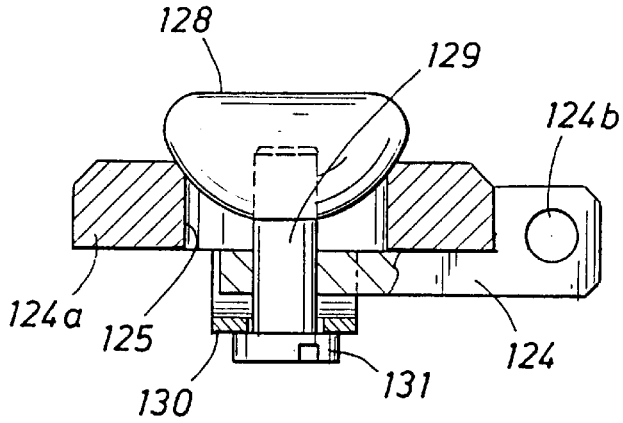
FIG. 1C
FIG. 1B
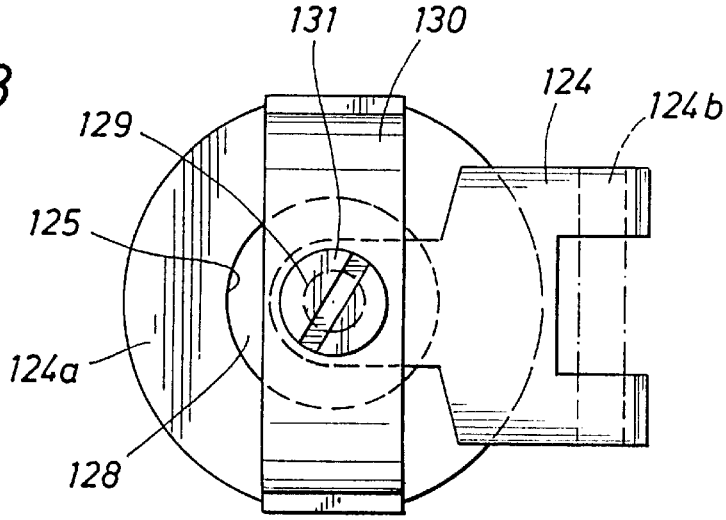

PDF VALVE

BACKGROUND OF THE INVENTION

1. Field of the Invention

The present invention relates generally to valve devices that have may be used in the construction of oil and gas wells. More specifically, the present invention relates to improved differential-fill and cementing equipment used to position and cement casing into a well bore.

2. Setting of the Invention

Differential-fill float and cementing assemblies employ a flow regulation valve in the casing string to control the filling of the lower end of the casing with drilling fluid as the casing is lowered into a well. Admitting regulated amounts of drilling fluid into the casing reduces the suspended weight of the casing string, allows the casing to sink through the drilling fluid and prevents the casing from collapsing. Once the casing is lowered into the proper position in the well bore, the valving in the assembly is reconfigured to permit a cement slurry to be pumped through the assembly into the annulus between the casing and the borehole. A complete description of differential-fill float and at cementing equipment of the type with which the present invention may be employed may be found in U.S. Pat. No. 4,729,432 (herein, the "'432 patent"). The '432 patent, belonging to the Assignee of the present application, is incorporated herein for all purposes.

The differential-fill operation of the assembly described in the '432 patent is provided by a small, pivoting flapper valve "piggybacked " on the flapper gate of a larger check valve. The check valve prevents back-flow of drilling fluid from the well into the casing. The small flapper valve permits a regulated amount of well fluid to flow into the casing through a flow passage in the gate of the check valve. A strong spring constructed of hard spring-steel biases the small flapper valve to its closed position preventing back-flow of drilling fluid into the casing. When the differential pressure between the drilling fluid in the well bore and that in the casing is sufficiently great, the spring bias is overcome and the small flapper valve pivots open to admit drilling fluid into the casing. The flapper spring closes the small flapper valve automatically when fluid admitted into the casing reduces the pressure differential below that required to open the valve. The flapper spring imposes a great deal of stress on the flapper hinge pin, requiring usage of a relatively large, high strength steel pin as the hinge pin.

After the casing has been cemented into the well, the differential-fill and cementing assembly must be milled or drilled out of the casing string. This removal process is facilitated by constructing the assembly with materials that are easily milled or cut by the drill bit. Brass and aluminum are commonly employed in the construction of the major structural components of the differential-fill and cementing equipment.

The springs used to regulate the opening of the regulating valves used in the differential-fill portions of the assembly are often provided by heavy coiled springs constructed of relatively hard spring-steel. The high strength steel flapper hinge pins and the steel springs, such as the pins and springs used for the small flapper valve of the '432 patent, are very difficult for a polycrystalline diamond compact (PDC) bit to mill or drill out of the casing.

SUMMARY OF THE INVENTION

A feature of the assembly of the present invention is that the poppet valve is centrally located in the differential-fill equipment and is moved along its central axis, parallel to the direction of fluid back-flow, as it travels between opened and closed positions. The regulating valve of the assembly operates without pivoting into and out of the centerline area of the flow stream and eliminates the need for a heavy steel hinge pin for the closure member of the regulating valve. The axial movement of the poppet valve maintains symmetrical flow past the valve to improve fluid flow regulation and minimize erosion of the valve components, which is particularly important where the components are constructed of plastics and/or composite materials. As compared with a standard piggybacked flapper arrangement, the configuration of the poppet valve and its placement on the flapper gate of the back-flow valve of the present invention contribute to an increase in the flow passage dimensions through the differential-fill equipment when the flapper gate is fully opened.

When the invention is employed as a differential-fill valve for lowering casing into drilling fluid, the major structural components and the pressure regulating biasing spring of the differential fill valve may be constructed of plastics and/or composite materials to facilitate the milling or drilling up of the valve. A leaf spring constructed of composite material may be employed to impose the biasing closing force on a poppet valve mounted in the flapper gate of the back-flow regulating valve. Elimination of a flapper valve as the regulating portion of the differential fill valve eliminates the need for a heavy steel hinge pin. In a preferred embodiment, the poppet valve, poppet valve biasing element, flapper valves and flapper hinge pins may be constructed of composite materials and/or plastics.

The regulating poppet valve of the present invention may be used in a combination, differential-fill and cementing assembly that is first used to automatically fill the casing as the casing is lowered into a well bore and then is remotely reconfigured from the well surface to conduct a cement slurry from the casing into the annulus between the casing and the well bore. The major structural components of the assembly, including the pressure regulating spring of the differential fill valve, may be constructed of composite materials and/or plastics to facilitate the milling or drilling up of the assembly after the casing has been cemented into the well bore.

As used herein, the term "composite materials" is intended to mean a combination of two or more materials (reinforcing elements, fillers, and composite matrix binder), differing in form or composition on a macro scale. Constituents retain their identities; that is, they do not dissolve or merge completely into one another although they act in concert. Normally, the components can be physically identified and exhibit an interface between one another.

From the foregoing, it will be appreciated that a major objective of the present invention is to provide a poppet valve in the closure element of a check valve that permits improved regulation of a back-flow of fluid through the check valve while minimizing turbulent fluid flow and valve erosion through the poppet valve.

An object of the present invention is to provide a subsurface fluid flow regulating valve in which the regulating portions of the valve are smoothly contoured and symmetrically oriented about a central axis and are moved in a direction parallel to the regulated fluid flow to improve flow regulation, minimize fluid turbulence and minimize erosion of the valve components.

A related object of the present invention is to provide a biasing spring constructed of a composite material that is sufficiently strong to bias the closure member of a regulating valve against the opening force of a pressurized fluid to maintain a predetermined pressure differential between the pressurized fluid and the area regulated by the valve.

Another important object of the present invention is to provide a regulating valve that can be easily drilled out of a casing string by a PDC bit.

Yet another object of the present invention is to provide a combination differential-fill and cementing valve assembly constructed primarily of plastics and/or composite materials whereby the assembly may be easily drilled out of a casing string with a PDC bit. A related object of the invention is to eliminate the need for a heavy steel flapper hinge pin in the regulating portions of the cementing valve assembly.

The foregoing objects, features and advantages of the present invention, as well as others, will be more fully appreciated and better understood by reference to the following drawings, specification and claims.

BRIEF DESCRIPTION OF THE DRAWINGS

FIG. 1A is an end view illustrating details of a piggybacked poppet valve on a flapper gate of a regulating valve of the present invention;

FIG. 1B is an end view of a modified piggybacked poppet valve on a flapper gate of a regulating valve of the present invention;

FIG. 1C is a side view of the poppet valve illustrated in FIG. 1B;

DETAILED DESCRIPTION OF THE ILLUSTRATED EMBODIMENTS

Figure 1:
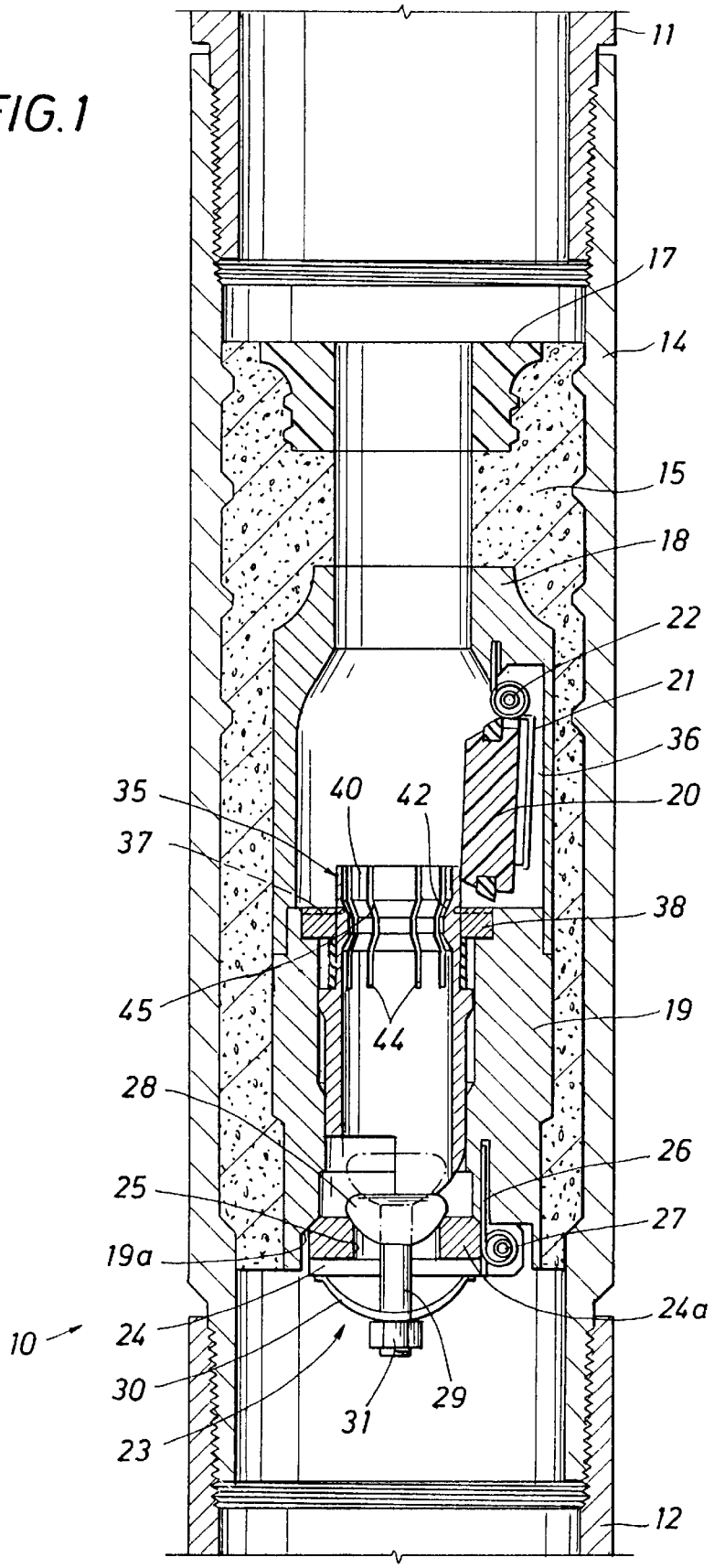
FIG. 1 is a vertical sectional view of a float collar assembly having a differential-fill and cementing assembly of the present invention illustrated in a casing string as the assembly appears during the lowering of the casing string through the drilling fluid in a well bore.

A combination differential-fill and cementing assembly including a poppet valve constructed in accordance with the teachings of the present invention is indicated generally in FIG. 1 as a float collar assembly 10. The float collar assembly 10 is illustrated threadedly connected in a casing string between a casing joint 11 and a casing joint 12. The collar assembly includes a steel tubular body 14 within which the back-flow and flow regulating valves are carried.

The valve components of the float collar assembly 10 are retained in place within the collar assembly body 14 by easily drilled bonding material 15. An annular seating ring 17 of elastomeric material at the top of the bonding material 15 functions as a shock absorber for receiving a setting ball introduced into the casing string from the well surface and used to convert the float collar assembly from its differential-fill function to its cementing function.

The valving of the float collar assembly 10 includes an upper, tubular, back-flow valve housing 18 secured at its lower end to a tubular, regulating flow valve housing 19. A flapper valve gate 20, illustrated locked back in the upper housing 18, is unlocked when the valve is converted to its cementing function. The valve gate 20, when unlocked, pivots between open and closed positions to permit one-way, downward flow of fluids through the float collar assembly.

A lightweight coiled spring 21 encircles a hinge pin 22 from which the flapper gate 20 pivots. The spring 21 provides a bias force tending to move the flapper gate 20 toward its closed position. Within the regulating flow valve housing 19, a regulating valve, indicated generally at 23, regulates the flow of fluids upwardly through the float collar assembly 10 during the lowering of the casing into the drilling fluid.

As may best be described by reference to FIGS. 1 and 1A, the regulating valve 23 includes a flapper valve with a flapper gate 24 having a central flow passage 25. The flapper valve gate 24 is biased to its closed position by a lightweight coil spring 26 encircling a hinge pin 27 from which the gate is pivoted. An annular sealing section 24*a* of the flapper gate 24 seats against a mating sealing surface 19*a* formed at the base of the regulating flow valve housing 19.

The flow passage opening 25 through the flapper gate is controlled with a piggybacked poppet valve assembly carried on the flapper gate 24. The poppet valve assembly includes a symmetrically formed, smoothly contoured closure element 28 with a stem 29 that extends centrally and axially from the closure element. A leaf spring 30, secured to the valve stem 29 with a nut 31, biases the poppet valve toward its closed position sealing the flow passage 25. The mounting of the closure element 28 in the regulating valve 23 and the connection with the leaf spring 30 constrain the closure element to move linearly in a direction along the central axis of the closure element 28, parallel to the linear flow of fluids through the float sleeve 10.

The leaf spring 30 imposes a strong biasing force that maintains the flow passage closed against the differential pressure acting across the closed flapper gate 24. The spring force determines the pressure differential required to open the flow passage and thus regulates the fluid level in the casing string above the float collar assembly 10.

The valve closure element 28 of the poppet valve included in the control valve 23 is centrally positioned axially within the flow passage 25 extending through the flapper gate 24. The movement of element 28 is coaxial with the float collar assembly and is parallel to the direction of fluid flow through the valve. The closure element 28 forms a symmetrical, smoothly continuous element centralized in the flow path of the drilling fluid entering the casing. The design and central placement of the control element 28 cooperates with the centralized flow passage opening 25 in the flapper valve gate 24 and the direct axial force applied by the leaf spring 30 to minimize turbulence in the drilling fluid flow and to more closely regulate the pressure response for opening and closing the poppet valve. The dimensions and placement of the leaf spring 30 on the flapper gate 24 also contribute to the symmetrical flow pattern to further minimize flow turbulence. The result is a reduction in the differential erosion in the sealing elements of the poppet valve and a corresponding improvement in the flow regulation of the valve.

During the time the casing is being lowered into the well bore; the back-flow valve gate 20 is locked open by a control sleeve indicated generally at 35. The control sleeve 35 operates as a valve change mechanism to change the function of the assembly 10. In its initial position within the float collar assembly 101 the sleeve 35 traps the flapper gate 20 to hold it in its open position within a recess 36 formed in the back-flow housing 18. The sleeve 35 is temporarily secured against axial motion by shear pins 37 extending from a support ring 38 anchored to the top of the regulating valve housing 19. As will be described hereinafter, the sleeve 35 is shifted axially downwardly by a setting ball to change the function of the float collar assembly 10.

The valve change function is assisted by circumferentially spaced collet fingers 40 that extend upwardly at the top end of the sleeve 35. The fingers 40 are equipped with internal, radially developed shoulder sections 42 extending radially inwardly from each of the collet fingers to collectively form a receiving seat for the setting ball. Circumferential gaps 44 between adjacent collet fingers 40 and between the shoulder projections 42 are filled and sealed with an elastomeric sealing material indicated at 45. The sealed sleeve shoulders and collet slots provide a continuous seat that cooperates with the setting ball to seal the flow passage through the float collar assembly 10.

Figure 2:
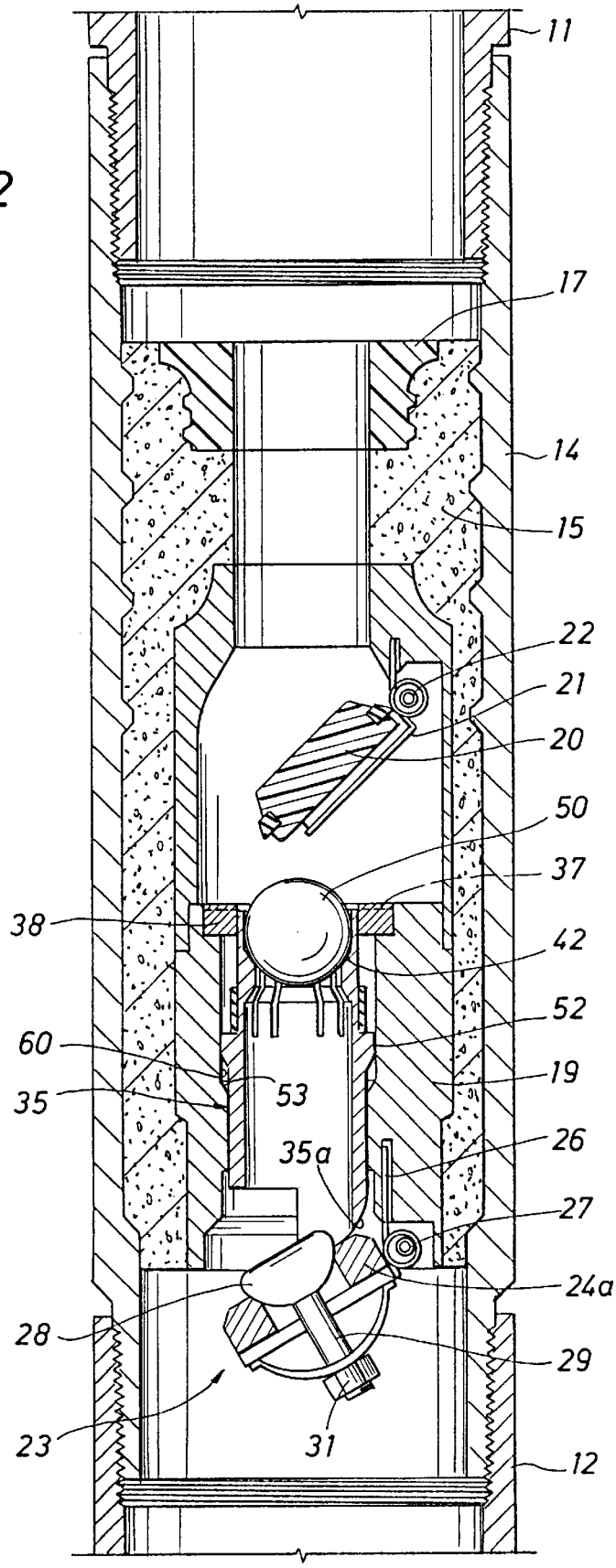
FIG. 2 is a vertical sectional view of the float collar assembly of FIG. 1 illustrating the disabling of the regulating differential-fill valve and the activation of a back-flow check valve before a cement slurry is to be pumped through the float collar assembly.

After the casing string has been lowered into the desired position within the well bore, a setting ball 50 is positioned in the casing and pumped down to the float collar assembly 10. As indicated in FIG. 2, the ball 50 passes through the central flow passage of the float collar assembly 10 and seats on the collet shoulder projections 42 where it seals the central opening through the sleeve 35. When a sufficiently high-pressure differential is exerted across the seated ball, the shear pins 37 sever and release the sleeve 35 from the support ring 38. The differential pressure acting across the ball 50 drives the sleeve 35 axially downwardly. The initial downward movement of the sleeve 35 frees the flapper gate 20, permitting it to pivot toward its closed position.

Figure 3:
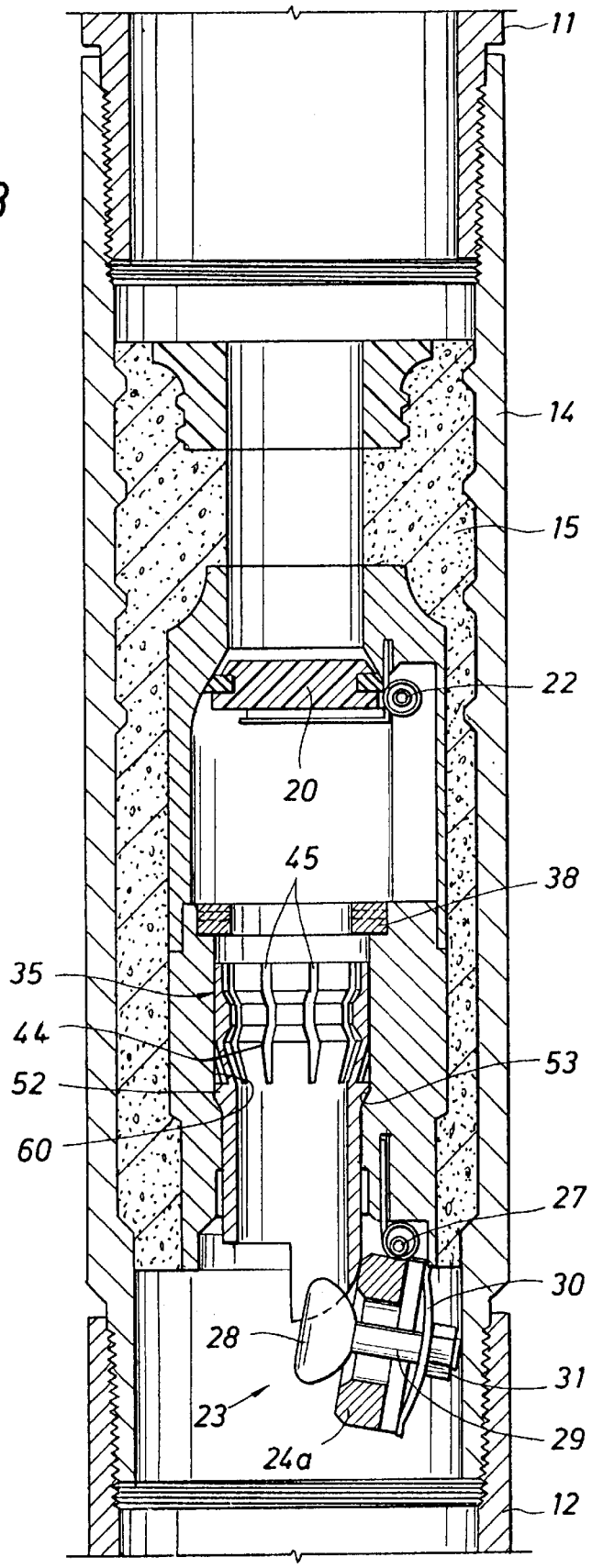
FIG. 3 is a vertical sectional view of the float collar assembly of FIG. 1 illustrating the float collar assembly fully opened and converted to a back-flow prevention valve for the introduction of a cement slurry through the float collar assembly.

With reference to FIG. 3, as the sleeve 35 moves axially downwardly, the bottom 35*a* of the sleeve engages the control valve 23 and pivots it into its fully open position. The downward travel of the sleeve is terminated when an external sleeve shoulder 52 engages an internal housing shoulder 53 to prevent further downward movement of the sleeve within the housing. At this lowermost position of sleeve travel, illustrated in FIG. 3, the control valve 23 is fully opened.

The continued application of a pressure differential across the ball 50 seated in the sleeve seat radially outwardly deforms the collet shoulder projections 42 and the collet fingers 40 into engagement with an internal cylindrical surface 60 extending through the regulator valve housing 19. The radial deformation of the collet fingers permits the ball 50 to move past the sleeve seat and travel through the float collar assembly 10 to the bottom of the casing. The engagement of the collet fingers with the internal housing surface 60 retains the sleeve 35 in its lowermost position of travel indicated in FIG. 3.

The cement slurry used to cement casing into the well bore is pumped through the float collar assembly when the float collar assembly 10 is in the configuration illustrated in FIG. 3. In this configuration, fluids pumped into the casing may flow freely through the float collar assembly 10 in a downward direction into the well bore. Reverse flow, in a direction toward the well surface, is prevented by the operation of the flapper valve gate 20. Once the float collar assembly is converted from its differential-fill function to its cementing function, the control valve 23 is displaced from the flow passage and has no effect on fluid flow in either direction.

With the exception of the tubular body 14, the float collar assembly 10 described in FIGS. 1 through 3 herein is preferably constructed entirely of plastics and/or composite materials. By way of example rather than limitation, the back-flow valve housing 18 and regulating flow valve housing 19 may be constructed of a suitable thermoset phenolic plastic. The flapper valve gates 20 and 24, shear pins 37, control sleeve 35 and poppet closure element 28 may be constructed of a suitable composite of fiberglass fibers and resin. The hinge pins 22 and 27 may also be formed from a suitable composite of fiberglass and resin. The elastomeric material used to seal, the openings between the collet fingers 40 may be a nitrile rubber or other suitable sealing material. The hinge springs 21 and 26 may also be made of a suitable resilient composite material that provides the minimal biasing force required to return the flapper valve into the flow stream.

While springs constructed of composite materials are preferable, the springs 21 and 26 may be constructed from a relatively soft, resilient steel material. Because the springs or of relatively small volume as compared with the hard, large volume, spring steel components employed to bias the control valve in conventional cement equipment, the resistance to a PDC bit is not excessive. The function of the springs 21 and 26 is merely to urge the flapper gates into the flow path of the fluid and, as contrasted with the springs employed to bias regulating valves, the springs need not overcome an opening force exerted by the fluid or pressure differential. The light springs 21 and 26 may thus be constructed of any suitable materials that provide a sufficient biasing force to move the flapper gates into the flow string. Such materials are not a significant obstacle to removal by a PDC bit.

FIGS. 1B and 1C illustrate a modified piggybacked poppet valve of the present invention mounted on a flapper valve gate 124. The gate 124 occupies less space and employs less material than the flapper gate and poppet arrangement illustrated in FIG. 1A. A leaf spring 130 extends laterally across the annular sealing section 124*a* of the flapper gate. The connection of the leaf spring 130 to the closure element 128 reduces the profile of the gate and poppet valve assembly to minimize the space required in the float collar when the gate 125 is fully opened.

The flapper gate 125 pivots about a hinge pin 124*b*. The leaf spring 130 connects to a stem 129 screwed into the closure element 128. The spring 130 is held to the stem by a slotted screw head 131.

While various preferred forms of the present inventions have been described in detail herein, it may be appreciated that many changes, additions and deletions may be made to the described embodiments without departing from the spirit and scope of the inventions, which are more fully defined in the following claims.

We claim:

1. A drillable regulating valve assembly for regulating the back-flow of fluid through a flow passage, comprising:

a seal area formed about said flow passage;

a valve closure element movable into and out of engagement with said seal area for respectively closing and opening said flow passage to said back-flow of fluid; and a biasing element constructed of a composite material for urging said valve closure element against the back-flow of said fluid and toward engagement with said seal area.

2. A drillable valve assembly as defined in claim 1 wherein said drillable valve is constructed primarily of composite materials.

3. A drillable valve assembly as defined in claim 1 wherein said biasing member comprises a leaf spring.

4. A drillable valve assembly as defined in claim 1 wherein said closure element is symmetrical about a central axis and moves parallel to said axis as said closure element moves into and out of engagement with said seal area.

5. A drillable valve assembly as defined in claim 1 wherein said seal area and said valve closure element are carried on a first movable valve member.

6. A drillable valve assembly as defined in claim 5 wherein said first movable valve member is a first flapper gate of a first one-way flow flapper valve that is movable from an open position that does not regulate flow through said drillable valve to a closed position for assisting in preventing back-flow of said fluid through said drillable valve.

7. A drillable valve assembly as defined in claim 6 further including a second one-way flow valve that is selectively operable to be movable from an open and locked position to a closed position for preventing the back-flow of said fluid through said drillable valve.

8. A drillable valve assembly as defined in claim 7 further including a valve change mechanism for holding said first flapper gate at an open position that does not regulate flow through said drillable valve.

9. A drillable valve assembly as defined in claim 8 wherein said valve change mechanism can be moved to unlock said second one-way flow valve for movement to a closed position that prevents back-flow of said fluid through said drillable valve.

10. A drillable valve assembly as defined in claim 9 wherein said valve change mechanism is operable for maintaining said first flapper gate in an open position that does not regulate flow through said drillable valve while said second one-way flow valve is unlocked to be movable to a closed position that prevents back-flow of said fluid through said drillable valve.

11. A drillable valve assembly as defined in claim 10 wherein said drillable valve is constructed primarily of composite materials and/or plastics.

12. A drillable well assembly as defined in claim 11 wherein said biasing member comprises a leaf spring.

13. A drillable valve assembly as defined in claim 12 wherein said closure element is symmetrical about a central axis and moves along said central axis as it moves into and out of engagement with said seal area.

14. A drillable valve assembly as defined in claim 13 wherein said drillable valve is a cementing valve included in a string of well pipe.

15. A drillable valve assembly as defined in claim 14 wherein said valve change mechanism comprises an axially extending sleeve that is axially shiftable within said drillable valve for unlocking said second one-way flow valve and maintaining said first flapper gate in an open position.

16. A drillable valve assembly as defined in claim 15 wherein said sleeve is axially shiftable by a setting ball introduced into said well pipe.

17. A regulating valve assembly for regulating a back-flow of fluid through a check valve, comprising:

a regulating flow passage extending through a movable closure element of said check valve;

a seal area surrounding said flow passage;

a poppet valve closure element mounted on said movable closure element and movable along a rectilinear path for regulating opening and closing of said regulating flow passage; and a biasing spring for urging said poppet valve closure element in a direction to close said regulating flow passage.

18. A regulating valve assembly as defined in claim 17, wherein said biasing spring comprises a composite material.

19. A regulating valve assembly as defined in claim 18 wherein said biasing spring comprises a leaf spring.

20. A regulating valve assembly as defined in claim 17, wherein said regulating valve is constructed primarily of composite materials.

21. A regulating valve assembly as defined in claim 20 wherein said biasing spring comprises a leaf spring.

22. A regulating valve assembly as defined in claim 17 wherein said biasing spring comprises a leaf spring.

23. A regulating valve assembly as defined in claim 17, wherein said poppet valve closure element is symmetrical about a central axis and moves parallel to said axis as said closure element moves into and out of engagement with said seal area.

24. A regulating valve assembly as defined in claim 17 wherein said movable closure element is a first flapper gate of a first one-way flow flapper valve that is movable from an open position that does not regulate flow through said regulating valve to a closed position for assisting in preventing back flow of said fluid through said regulating valve.

25. A regulating valve assembly as defined in claim 24 further including a second one-way flow valve that is selectively operable to be movable from open and locked position to a closed position for preventing the back flow of said fluid through said regulating valve.

26. A regulating valve assembly as defined in claim 25 further including a valve change mechanism for holding said first flapper gate at an open position that does not regulate flow through said regulating valve.

27. A regulating valve assembly as defined in claim 26 wherein said valve change mechanism is operable for maintaining said first flapper gate in an open position that does not regulate flow through said regulating valve while said second one-way flow valve is unlocked to be movable to a closed position for preventing back-flow of said fluid through said regulating valve.

* * * * *